United States Patent [19]

Quennessen

[11] Patent Number: 4,832,220

[45] Date of Patent: May 23, 1989

[54] CONTAINER CLOSURE

[75] Inventor: Rene Quennessen, Creteil, France

[73] Assignee: AMS Packaging, Saint-Ouen-L'Aumone, France

[21] Appl. No.: 147,316

[22] Filed: Jan. 22, 1988

[30] Foreign Application Priority Data

Jan. 23, 1987 [FR] France ..... 87 00786

[51] Int. Cl.[4] ..... B65D 41/04

[52] U.S. Cl. ..... 215/331

[58] Field of Search ..... 215/330, 331, 332

[56] References Cited

U.S. PATENT DOCUMENTS

| | | | |
|---|---|---|---|
| 3,659,735 | 5/1972 | Landen . | |
| 4,093,096 | 6/1978 | Augros | 215/331 X |
| 4,373,641 | 2/1983 | Banich | 215/331 |
| 4,591,063 | 5/1986 | Geiger | 215/330 |
| 4,691,833 | 9/1987 | Ahrens | 215/331 X |

FOREIGN PATENT DOCUMENTS

| | | |
|---|---|---|
| 2342908 | 9/1977 | France . |
| 2567104 | 1/1986 | France . |
| 84/00505 | 2/1984 | PCT Int'l Appl. . |

*Primary Examiner*—Donald F. Norton

*Attorney, Agent, or Firm*—Mason, Fenwick & Lawrence

[57] ABSTRACT

A device for closing a container having a neck, in particular a bottle or pot for a cosmetic product, of the type having structure for axial tightening by screwing of a cap onto the neck of the container and for the angular positioning of the cap with respect to the container. The angular positioning structure comprises at least one lug of the container extending substantially axially upwards from a shoulder surface of the container substantially perpendicular to the tightening axis and at least one tongue member of the cap which is elastically deformable in the axial direction co-operating with such lug in order to vary the axial tightening force at the time of the opening and closing operations.

7 Claims, 3 Drawing Sheets

CONTAINER CLOSURE

Figure 1:
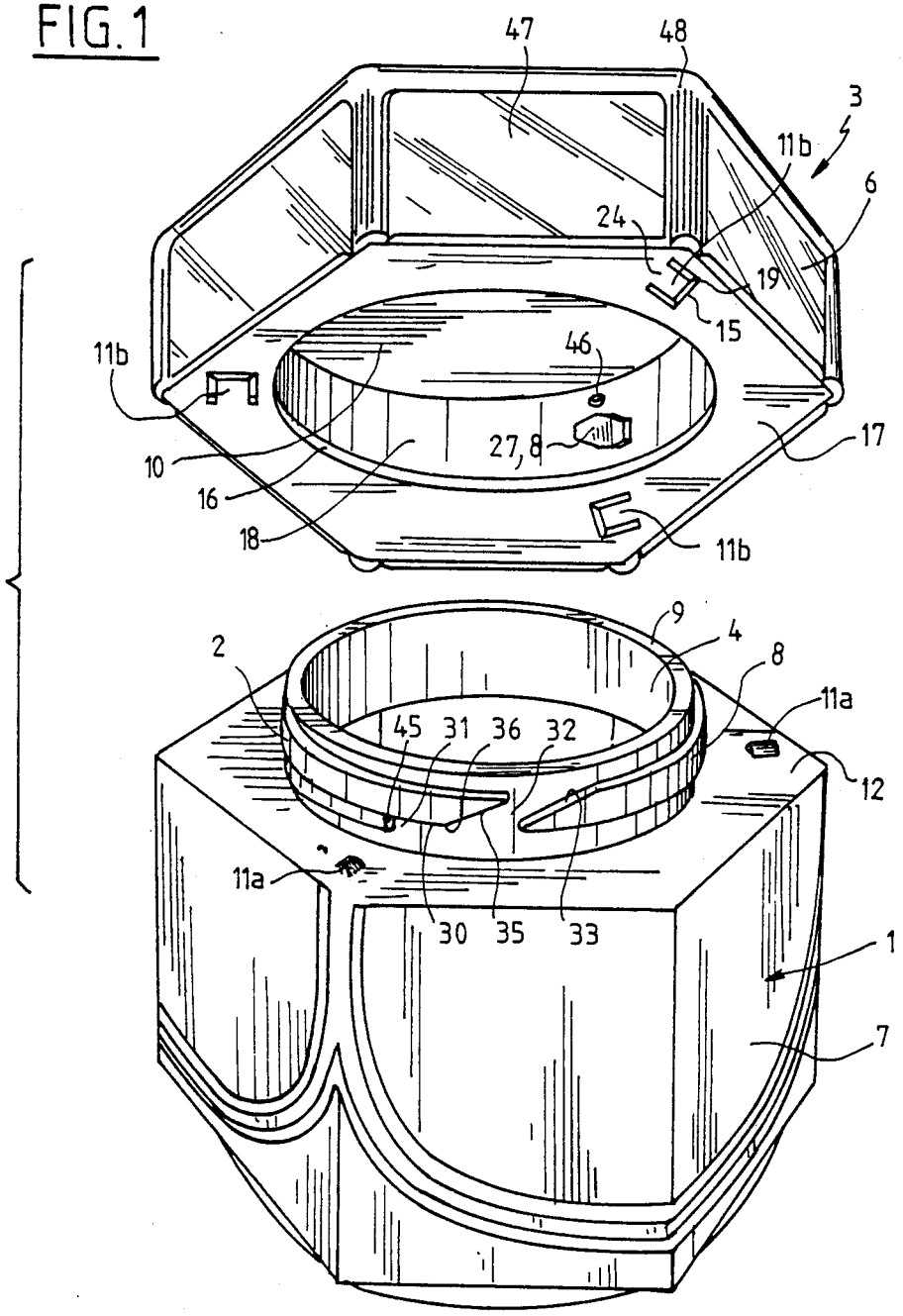

The invention relates to a device for closing a container having a neck comprising means for positioning a cap tightened on the neck of the container in order to seal it hermetically whilst allowing subsequent opening and closing operations.

Numerous screw-thread closure devices are already known comprising means for the axial and angular positioning of a cap with respect to a container. The means for axial positioning allow controlled tightening of the cap on the neck. The means for angular positioning, in turn make it possible to align the cap perfectly with respect to the container in the closed position, when the cap and/or the container are not symmetrical as regards revolution and this is to make the arrangement aesthetic. In addition, these angular positioning means are intended to prevent accidental opening.

French Patent Nos. 2,036,272 and 2,041,494 describe closure devices comprising means for the angular positioning of a cap with respect to the container. These devices are satisfactory to the extent that they ensure satisfactory angular positioning. However, it has been found in practice that they wear relatively quickly in the case of repeated or regular use. In addition, at the time of the opening or closing operations, one is compelled to overcome a stop or a resistance. It has been found that this stop or resistance to opening is poorly accepted by the public, in particular in the field of cosmetics and discourages users. When closing the container, the user frequently neglects to overcome this stop or resistance and the container remains inadequately sealed.

French Patent No. 2,471,926 describes a closure device, for which housings are provided at the end of each female thread of the neck. Each housing extends substantially perpendicularly to the axis and around the neck from the end of the thread with which it defines a firm tightening point and comprises a terminal flange extending in the axial direction and forming an angular stop for the male projections of the cap. This device is satisfactory in that it allows simple and rapid operations, without a stop or too great a resistance, thus preventing accidental opening and ensuring a satisfactory seal in the closed position. In addition it ensures good positioning of the cap with respect to the container when the latter can be precision manufactured, in particular when the manufacturing dimensions of the threads and housings of the neck may be produced with precision. However, it has been noted that when the container consists of glass and is made in very large quantities, it is in practice impossible to obtain sufficient precision when producing housings. Thus, since the angular stops do not have a regular and precise position, angular positioning of the cap is not perfect.

The invention intends to remedy the drawbacks of known devices and relates to a closure device providing perfect angular and axial positioning of a cap on a container—in particular a cap of synthetic material on a glass container—ensuring tightness of the closure whilst allowing opening and closing operations without a stop and preventing any accidental opening. Another object of the invention is a device of this type also having great reliability and maintaining its properties in the case of regular and repeated use. Another object of the invention is a closure device of this type whereof the cost price is very low.

To this end, the invention proposes a closure device for a container comprising a neck, in particular a bottle or pot for a cosmetic product, of the type comprising means for axial tightening by screwing of a cap on the neck of the container and means for the angular positioning of the cap with respect to the container of the general type comprising a lug of the container and a resilient tongue of the cap defined by an incision, characterised in that a lug extends substantially axially upwards from the shoulder surface substantially perpendicular to the tightening axis; the tongue able to be depressed axially upwards in the cap under the action of a lug, being formed by the incision made through a lower wall of the cap whereof the free edge opposite the free end of the tongue constitutes an angular, end-of-travel stop co-operating with the lug at the end of the screwing travel in order to lock the cap in an angular manner with respect to the container when they arrive in the aligned closure position, the screwing torque C decreasing continuously at the time of closure and increasing at the time of opening.

According to the invention, each elastically deformable member is formed in order to offer resistance to each lug whereof the value decreases continuously at the end of the tightening travel so that the screwing torque decreases continuously at the time of closure and increases continuously at the time of opening.

The positioning means also comprise at least one angular stop co-operating with the lug at the end of the screwing travel in order to lock the cap in an angular manner with respect to the container when they reach the aligned closed position. Each elastically deformable member of the positioning means is advantageously constituted by a tongue able to be depressed axially towards the top of the cap by pivoting about its line of connection to the cap under the action of a lug of the container.

According to the invention, the container may be made from hard and rigid material, in particular from glass and the cap from flexible material, in particular synthetic material.

The features of a closure device according to the invention may be combined with those of French Patent No. 2,471,926, in order to improve the performance thereof.

The invention thus provides a closure device which is very pleasant to operate, that is to say without a stop, ratchet or sudden resistance. The variations in the tightening force are on the contrary continuous. In addition, the angular positioning of the cap is perfect and accidental opening is completely impossible. The device according to the invention may be used repeatedly and regularly without losing its properties and it has a long useful life. The seal may be achieved under the best conditions. The cost price of a device according to the invention and thus the quality/cost ratio are very low with respect to those of the prior art.

Figure 2:
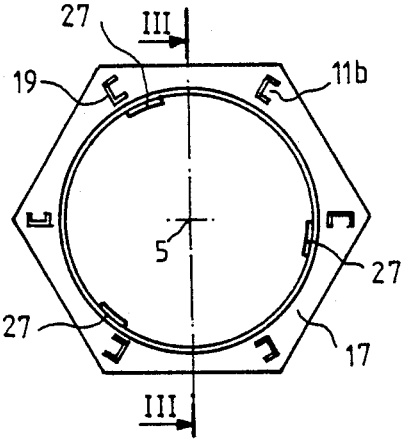
Figure 3:
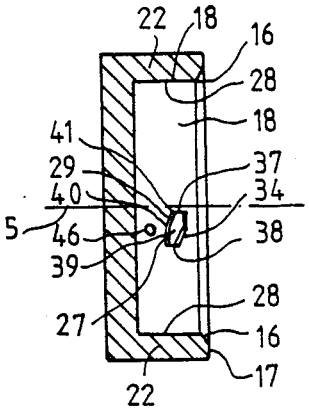
Figure 4:
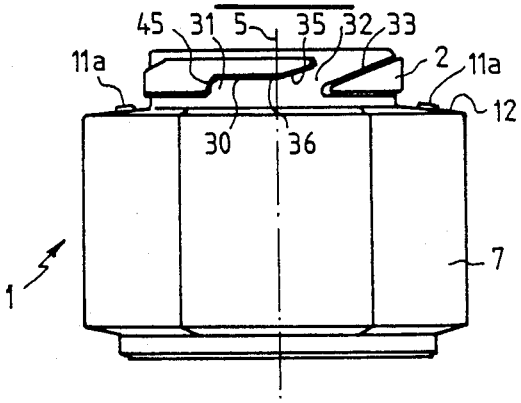
Figure 5:
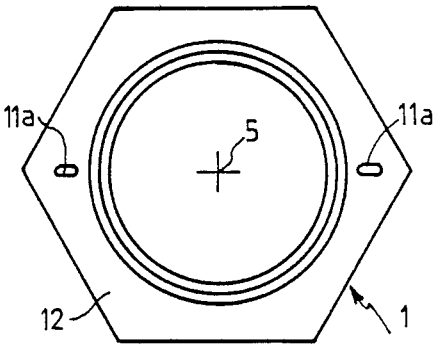
Figure 6:
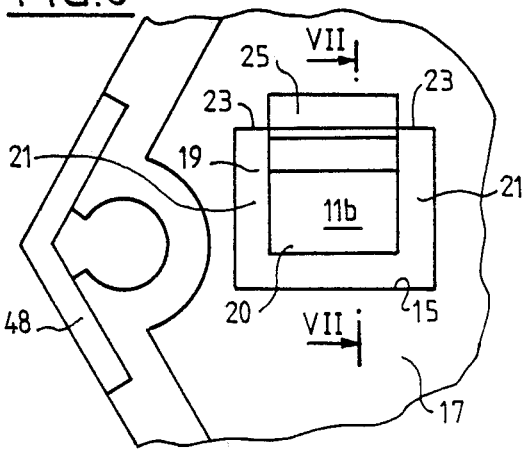
Figure 7:
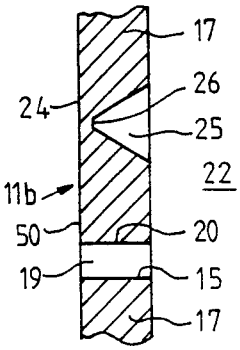
Figure 8:
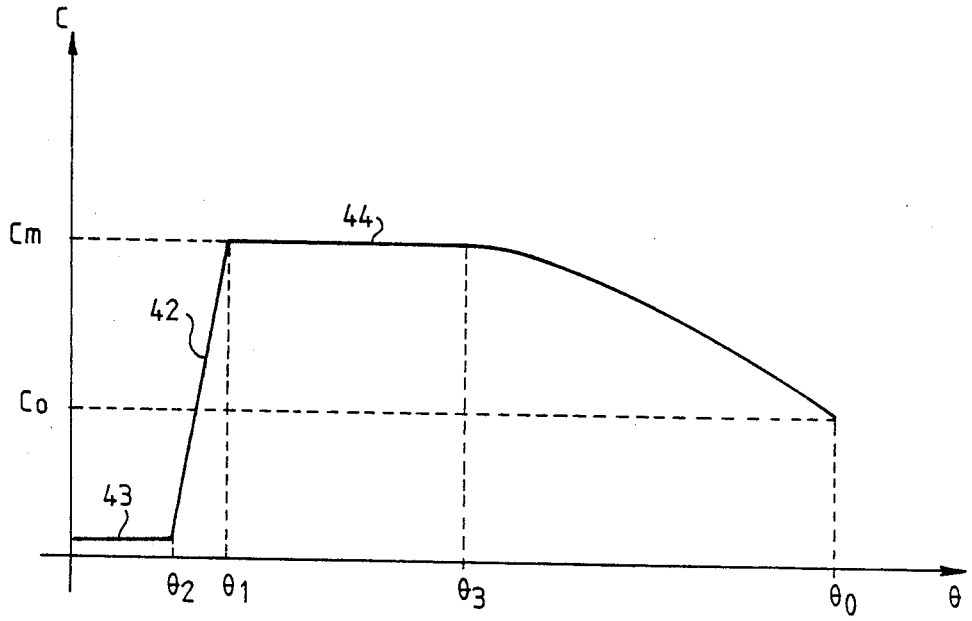

Further advantages and features of the invention will become apparent on reading the following description of one of its preferred embodiments, referring to the accompanying drawings in which:

FIG. 1 is a perspective view of a device according to the invention, including the container for which it is intended, FIG. 2 is a bottom view of a member forming the cap of a device according to the invention, FIG. 3 is a sectional view on line III—III of FIG. 2, FIG. 4 is an elevational view of a container to which may be fitted a cap such as that illustrated in FIGS. 2 and 3, according to the invention, FIG. 5 is a top plan view of FIG. 4, FIG. 6 is an enlarged fragmentary view of a cap according to the invention, FIG. 7 is a fragmentary sectional view on line VII—VII of FIG. 6, FIG. 8 shows the variations of the screwing torque C during closing and opening operations of a device according to the invention.

The invention relates to a device for the closure of a container 1 comprising a neck 2 by a cap 3 or the like. The closure device as such is constituted partly by the cap 3 and partly by members of the container 1. The container 1 may be a bottle, or a pot or the like. In all cases, the neck 2 defines a mouth 4 and an axis of symmetry 5 which is assumed to be vertical hereafter, the mouth 4 being directed upwards, although this is not necessary. On the other hand, neither the container 1, nor the cap 3 are generally symmetrical as regards revolution about the axis 5 and this is why it is necessary to position the cap 3 perfectly with respect to the container 1. However, the invention is also applicable for a container 1 and a cap 3 which are symmetrical as regards revolution. In the example shown, the cap 3 and the container 1 have a hexagonal polygonal shape in cross-section. When the cap 3 is satisfactorily positioned, the outer faces 6 of this cap 3 are aligned with the outer faces 7 of the container which is substantially perpendicular to the tightening axis 5 connecting the outer faces 7 of the container to the neck 2.

A closure device of this type comprises means 8 for tightening along the axis 5 by screwing of the cap 3 onto the neck 2 of the container 1, making it possible to produce a seal by the co-operation of the free terminal edge 9 of the neck 2 with a suitable sealing device, which is not shown, located at the bottom 10 of the cap 3. The closure device also comprises means 11 for the angular positioning of the cap 3 with respect to the container 1.

According to the invention, the angular positioning means 11 comprise at least one lug 11*a* on the container 1 extending substantially axially upwards from the shoulder surface 12 substantially perpendicular to the tightening axis 5 and at least one member 11*b* of the cap 3 which is elastically deformable in the axial directioon co-operating with the lug 11*a* in order to vary the axial tightening force at the time of opening and closing operations. Each elastically deformable member 11*b* is formed in order to offer resistance to each lug 11*a* whereof the value decreases continuously at the end of the tightening travel, so that the screwing torque C decreases continuously at the time of closure and increases continuously at the time of opening.

FIG. 8 shows the variations of the screwing torque C which must be exerted, depending on the screwing angle $\theta$ of the cap 3 on the container 1, in order to reach the closure position corresponding to the angle $\theta_0$. This screwing torque C is directly linked with the axial tightening force of the cap 3 on the container 1.

Between $\theta=O$ and $\theta=_1$, the cap 3 is loosely fitted on the neck 3, sufficient to produce contact of the lugs 11*a* with the cap 3 at $\theta=\theta_2$ and to achieve the engagement of the radial male projections 27 in the tightening ramps 30 at $\theta=\theta_1$, as described hereafter.

From $\theta=\theta_1$, an angle corresponding to this bringing into contact and to this engagement, the screwing torque C rises to a maximum value Cm and thereafter slowly decreases continuously at the time of screwing on the cap until it reaches the perfect positioning where $\theta=\theta_0$. It will be noted that the screwing torque $C-C_0$ and thus the corresponding axial tightening force, is not zero for $\theta=\theta_0$, i.e. in the closed position. The user thus encounters no sudden variation in the screwing torque C such as would be caused by an end-of-travel stop or detent, that is to say in the vicinity of $\theta=\theta_0$. However it is possible to provide an increase in the screwing torque C before $\theta=\theta_1$, as described hereafter.

The positioning means 11 also comprise at least one angular stop 15 co-operating with the lug 11*a* at the end of the screwing travel in order to lock the cap 3 in an angular manner with respect to the container 1 when they arrive in the aligned closure position in which the container 1 is sealed.

Each elastically deformable member 11*b* of the positioning means 11 is constituted by a tongue 11*b* able to be depressed axially towards the top of the cap 3 by pivoting about its line of connection 24 to the cap 3 under the action of a lug 11*a* of the container 1 from a certain value Cm imparted to the screwing torque C by the user. The lug 11*a* comes into contact against the tongue 11*b* and rubs against its outer surface 50.

Preferably, the cap 3 is hollow and comprises a wall 17 extending substantially perpendicularly to the tightening axis 5, towards the outside from the lower free edge 16 of the inner skirt 18 of this cap co-operating with the neck 2 of the container 1. This skirt 18 and the neck 2, which are symmetrical as regards revolution about the axis 5, constitute the means 8 for tightening by screwing of the cap 3 onto the container 1. According to the invention, each tongue 11*b* is formed by an incision 19 of general U-shape made through this lower wall 17 of slight thickness. The free edge 15 formed in this way from the wall 17 opposite the free end 20 of the tongue 11*b* and forming the web of the "U", constitutes the said angular end-of-travel stop 15. The lower wall 17 of the cap 3 is preferably substantially flat.

A positioning lug 11*a* extends substantially axially from the shoulder surface 12 of the container 1 in an upwards direction and over a certain radial width. The distance between the sides 21 of the incision 19 forming a positioning tongue 11*b* is greater than the radial width of a lug 11*a*, so that this lug 11*a* may elastically deform the tongue 11*b* by depressing it in the upwards direction on the inside 22 of the cap 3 through the wall 17.

The ends 23 of the sides 21 of the "U" formed by the incision 19 define the line of connection 24 of a tongue 11*b* to the wall 17, about which this tongue 11*b* pivots under the action of a lug 11*a*. Advantageously, the line of connection 24 of each tongue 11*b* to the lower wall 17 of the cap 3 comprises a notch 25 provided in its thickness facilitating the pivoting of the tongue 11*b* about this line of connection 24. The thickness of the tongue 11*b* is thus less at the level of this connecting line 24 than at its centre.

The outer surface 50 of the tongue 11*b* against which a lug 11*a* will rub may be shaped—in particular recessed—depending on the desired variations of the screwing torque C. For example, its thickness may decrease from its line of connection 24 as far as its free end 20. The angular end-of-travel stop 15 may also be formed on the tongue 11*b* itself by a return of the free end 20 extending axially and downwards.

Preferably, the notch 25 in a line of connection 24 of a tongue 11*b* is provided on the upper side of the wall 17, directed towards the inside 22 of the cap 3, has a cross-section substantially in the shape of a "V" (FIG. 7), the angle defined by the sides being between 45° and 90°, preferably in the order of 60°. The base 26 of the notch 25 is parallel to and perpendicular to the straight line joining the ends 23 of the sides 21 of the incision 19.

The tongue 11*b* returns naturally to its inoperative position in which it is aligned with the wall 17 when the lug 11*a* is not co-operating therewith (FIG. 7).

The tightening means 8 are constituted by the skirt 18 of the cap 3 comprising radial projections 27 towards the inside, uniformly distributed over the inner wall 28 of this skirt 18. Each projection 27 co-operates by its upper face 29 with a tightening ramp 30 of the neck 2, which is substantially perpendicular to the tightening axis 5 at least in its end part 31 and faces downwards.

The radial projections 27 may be moved axially downwards when they co-operate with the tightening ramps 30, since the neck 2 has no other ramps facing upwards opposite the tightening ramps 30 and which would co-operate with these projections 27. In this way, the axial movements of the cap 3 in a downwards direction are limited by the co-operation of the lugs 11*a* of the positioning means 11 with the cap 3, in particular with the wall 17 and/or the tongues 11*b*. The number of the tightening ramps 30 is equal to the projections 27 and they are uniformly distributed around the neck 2.

The device according to the invention comprises, for each positioning lug 11*a*, a number of tongues 11*b* equal to the number of radial projections 27 or tightening ramps 30. In the variation illustrated in FIG. 1, the device comprises three tightening ramps 30 uniformly distributed around the neck 2 of the container 1, three radial projections 27 of the cap 3 spaced by an angle of 120°, co-operating with these ramps 30, three positioning lugs 11*a* spaced by an angle of 120° on the lower wall 17 of the cap 3 in order to co-operate with the three lugs 11*a*.

In another variation (FIGS. 2 to 5), the cap 3 comprises six tongues 11*b* which are uniformly distributed and three projections 27. The container 1 thus comprises three tightening ramps 30 and two diametrically opposed lugs 11*a*.

Preferably, the device according to the invention comprises for each radial projection 27 and each tightening ramp 30, a thread 32 for guiding (FIG. 4) each projection 27 towards each tightening ramp 30, so that the co-operation of the projection 27 with the tightening ramp 30 is obtained by screwing of the cap 3. A guide thread 32 is provided by an inclined ramp 33 facing upwards and co-operating with the lower face 34 of the projection 27 and by an inclined ramp 35 facing downwards and co-operating with the upper face 29 of the projection 27. This latter inclined ramp 35 is joined to the tightening ramp 30 by an edge 36. The upper and lower faces 29, 34 of a projection 27 are at least partly inclined substantially by the same inclination as the ramps 33, 35 with which they co-operate. The upper face 29 of a projection 27 also comprises a substantially horizontal rear part 39 (perpendicular to the tightening axis 5) and which may co-operate with the tightening ramp 30. A projection 27 also comprises two substantially vertical side faces 37, 38.

According to the invention, at the time of closure, each lug 11*a* comes into contact with the lower wall 17 of the cap 3 before each projection 27 has passed beyond the edge 36 joining the tightening ramp 30 and the thread 32, so that when the projections 27 are engaged in the tightening ramps 30, the contact of each lug 11*a* with the lower wall 17 causes stresses and elastic deformations in the cap 3 and at least at the end of travel, the elastic deformation of a tongue 11*b* co-operating with the lug 11*a*. The maximum value Cm of the screwing torque corresponds to $\theta=\theta_1$, a position for which each projection 27 and more precisely each joining edge 40 between the rear part 39 and the inclined part 41 of the upper face 29 of the projection 27, has crossed the joining edge 36. This crossing corresponds to the steeply inclined portion 42 of the curve of FIG. 8, between $\theta=\theta_2$ corresponding to bringing the lugs 11*a* into contact with the lower wall of the cap 3 and $\theta=\theta_1$. The portion 43 of the horizontal curve up to $\theta=\theta_2$ corresponds to the screwing of the projections 27 in the threads 32. The horizontal portion 44 between $\theta=\theta_1$ and $\theta=\theta_3$ corresponds to the travel of the lugs 11*a* on the wall 17 before the tongues 11*b*.

At $\theta=\theta_3$, the lugs 11*a* pass the lines of connection 24 and co-operate with the tongues 11*b*. The screwing torque C decreases between $\theta_3$ and $\theta_0$. In addition, the curve has no acute angle between $\theta_1$ and $\theta_0$.

The shape of the threads 32 as well as the positions of the tongues 11*b* with respect to the projections 27 and of the lugs 11*a* with respect to the threads 32 and to the tightening ramps 30 could be modified and adapted at will in order to alter the shape of the curve illustrated in FIG. 8. In particular, one could eliminate the portion 44 between $\theta_1$ and $\theta_3$ by having $\theta_1=\theta_3$. One could even provide that the contact of the lugs 11*a* with the cap 3 takes place on the lines of connection 24 ($\theta_2=\theta_3$) indeed on the body of the tongues 11*b* ($\theta_2>\theta_3$).

Each tightening ramp 30 terminates in a substantially vertical edge 45. Preferably, the length of a tightening ramp 30 is sufficient in order that the contact between the front face 37 of the projection 27 and this edge 45 never occurs. It is possible to provide that the two contacts occur roughly simultaneously or virtually simultaneously for $\theta=\theta_0$, so that the angular stop is reinforced by the abutment of the projection 27 against the edge 45.

The sealing means not shown may be constituted by a disc of deformable foam inserted in the skirt 18 of the cap 3 and held on the base 10 of this skirt by lugs 46 projecting radially inwards.

The cap member 3 illustrated in FIGS. 2 and 3 is the main internal part forming the lower wall 17, the skirt 18, the base 10. This member is advantageously covered by an outer facing formed for example by a cover 47 and a connecting frame 48.

The invention may have numerous variations which are obvious to a man skilled in the art. For example, the tongues 11*b* may be replaced by any equivalent means which are elastically deformable in the axial direction (springs . . .).

I claim:

1. A device for closing a container having a neck, in particular a bottle or pot for a cosmetic product, comprising a container, a cap therefor, tightening means for axially tightening a cap on the neck of the container by screwing the cap and positioning means for angularly positioning the cap with respect to the container, the positioning means comprising a lug on the container and an elastic tongue on the cap, the lug on the container extending substantially axially upwards from a shoulder surface of the container in a direction substantially perpendicular to a central longitudinal axis passing through the container neck; the tongue on the cap being depressible axially in an upward direction toward the cap under the action of said lug on the container and having a free edge opposite a free end of said lug, said free edge forming an angular end-of-travel stop cooperating with said lug at the end of screw travel in order to lock the cap in an angular manner with respect to the container when the cap and container arrive at an aligned closure position.

2. Device according to claim 1, wherein said each tongue has a line of connection to the lower wall of the cap comprising a notch facilitating its pivoting about this line of connection.

3. Device according to claim 2, wherein the notch in a connecting line of a tongue is provided on an upper side directed towards the inside of the cap.

4. A device according to claim 2, wherein the notch in the line of connection of said tongue has a cross-section substantially of "V"-shape.

5. A device according to claim 4, wherein said notch at a line of connection of said tongue defines an angle of opening between 45° and 90°.

6. A device according to claim 1, wherein said tightening means are formed in a skirt of the cap and comprise radial projections uniformly distributed on an inner periphery of the skirt, each projection co-operating by an upper face thereof with a tightening ramp on said neck substantially perpendicular to said central longitudinal axis.

7. A device according to claim 6, wherein there is provided for each said projection and each said tightening ramp, a thread for guiding each projection towards each tightening ramp so that co-operation of the projection with the associated tightening ramp is obtained by screwing of the cap, each lug being located to come into contact with a lower wall of the cap before the associated projection has passed beyond the location where the tightening ramp joins the thread so that when the projections are engaged with the tightening ramps, the contact of each lug with the lower wall causes stresses and elastic deformations in the cap.

* * * * *